United States Patent [19]

Reams

[11] Patent Number: 5,005,482

[45] Date of Patent: Apr. 9, 1991

[54] COMBINED MINE SAFETY DEPLOYMENT AND ACTIVATION SYSTEM

[75] Inventor: William H. Reams, Keedysville, Md.

[73] Assignee: The United States of America as represented by the Secretary of the Navy, Washington, D.C.

[21] Appl. No.: 612,286

[22] Filed: May 21, 1984

[51] Int. Cl.[5] ..... F42B 22/36

[52] U.S. Cl. ..... 102/420; 102/223; 102/229

[58] Field of Search ..... 89/1.55, 1.51; 102/419, 102/420, 406, 424, 229, 228, 223, 263, 264

[56] References Cited

U.S. PATENT DOCUMENTS

| | | | |
|---|---|---|---|
| 2,960,030 | 11/1960 | Semon | 102/420 |
| 3,722,407 | 3/1973 | Fogel et al. | 102/420 |
| 4,038,901 | 8/1977 | Backstein | 102/223 X |
| 4,369,709 | 1/1983 | Backstein | 102/420 X |
| 4,487,126 | 12/1984 | Schaper | 102/229 |

*Primary Examiner*—David H. Brown

*Attorney, Agent, or Firm*—Kenneth E. Walden

[57] ABSTRACT

A naval mine combined fail-safe deployment and activation system which, after the mine has been dropped from an aircraft, deploys a parachute to slow its descent and thereafter arms a target detection device when the mine has settled into the water to a predetermined depth for exploding the mine when a target is detected.

8 Claims, 3 Drawing Sheets

COMBINED MINE SAFETY DEPLOYMENT AND ACTIVATION SYSTEM

BACKGROUND OF THE INVENTION

This invention relates to a fail-safe arming device for a naval mine of the type adapted to be dropped from an airplane, slowed in its descent into water by parachute, and allowed to settle to the bottom.

Previous naval mines did not provide a fail-safe arming delay after the mine entered the water. This invention combines a parachute deployment with a water pressure sensing feature for delayed arming.

SUMMARY OF THE INVENTION

The present invention is concerned with a fail-safe arming device for naval mines of the type adapted to be laid from aircraft. The device operates in two stages: first, when the mine is separated from the aircraft and, second, after it has settled in water to a predetermined depth. The arming device employs two spring loaded pistons which are caused to operate in sequence. Upon the mine falling away from the aircraft, a lanyard is pulled free from both pistons. Once free of lanyard restraint, a first piston is linearly projected to strike a percussion primer in a short life battery to cause electrical activation of the battery and selectively close two switches to deploy a parachute and initiate a portion of a target detection device aboard the mine. A second piston, although also released by the lanyard, remains inactive until the mine has fallen into the water and settled to a predetermined depth. There, water pressure operates the second piston against spring pressure to mechanically unlock an out-of-line explosive train and to close switches for activating a long life battery to energize a motor for rotating a disc to align an electric detonator with an explosive train. Once the disk has been rotated to a predetermined location, another switch is closed to activate another battery associated with the target detection device (TDD).

It is, therefore, an object of the invention to provide an improved fail-safe deployment and activation system for a naval mine.

It is another object of the invention to provide a two-stage fail-safe activation system for a naval mine.

Other objects of the invention will become evident to one skilled in the art upon a review of the drawing and a reading of the specification.

DETAILED DESCRIPTION

Figure 1:
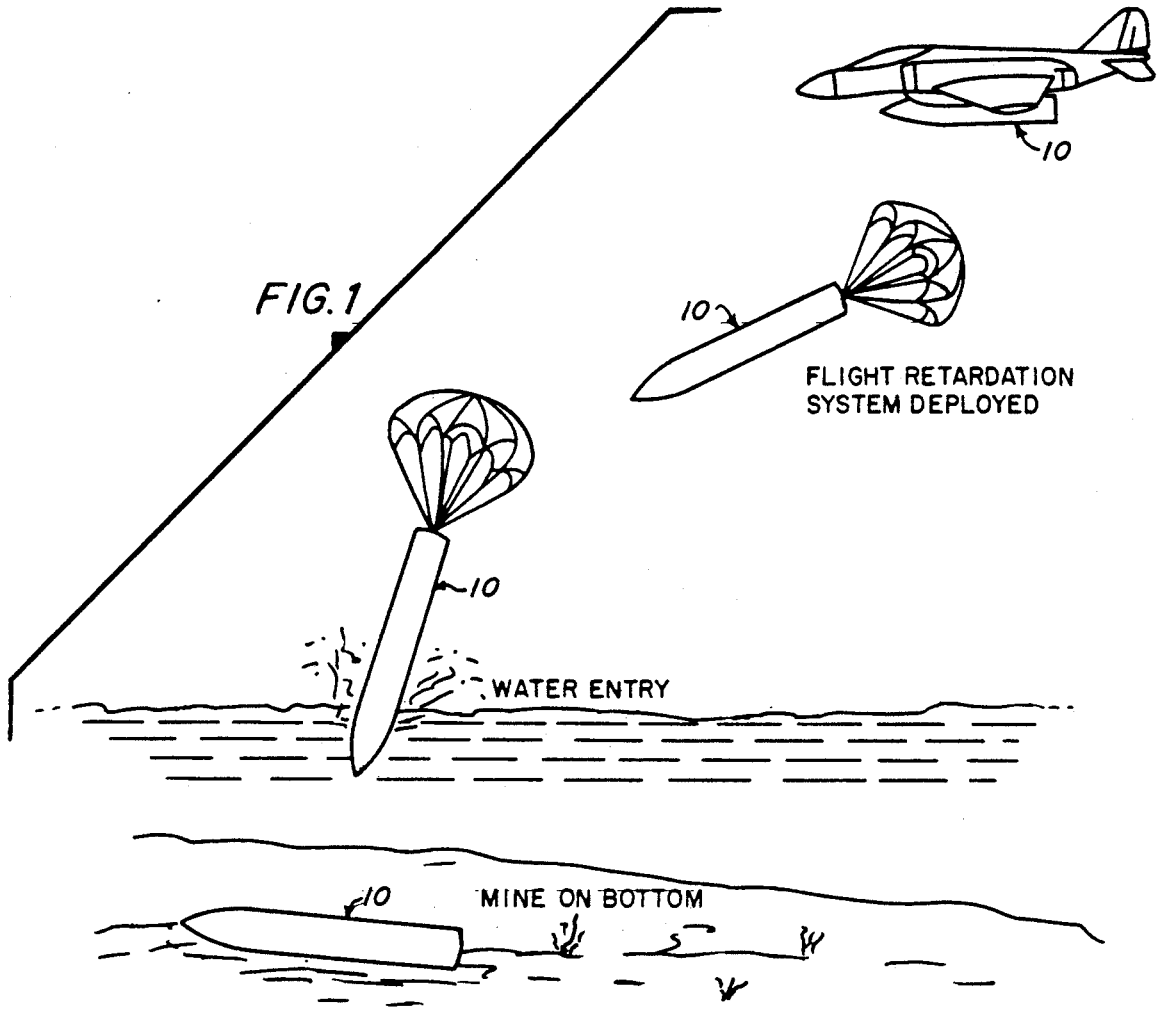
FIG. 1 illustrates stages of deploying a naval mine into shallow water from a high speed aircraft operating at low altitude.

The invention relates to a device for aiding deployment of a naval mine from an aircraft into water and for activating it. The mine cannot become armed except through the completion of a series of steps. There is illustrated in FIG. 1 the steps of deploying a naval mine 10 from an aircraft.

The mine is adapted to be carried by shackles beneath or in an aircraft with a lanyard fixedly attached thereto. Once the mine is released from its shackles, the lanyard is pulled free to allow a sequence of steps to occur which are completed only after the mine has entered the water and has settled to the bottom at or beyond a predetermined water depth.

Figure 2:
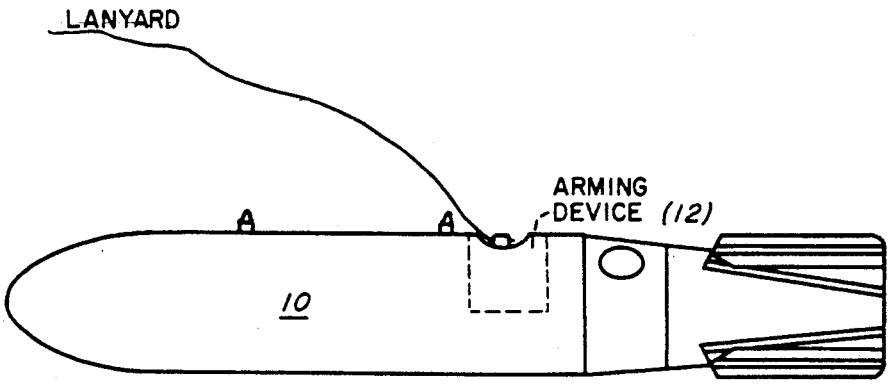
FIG. 2 is a side view of a naval mine of a type employing the invention.
Figure 3:
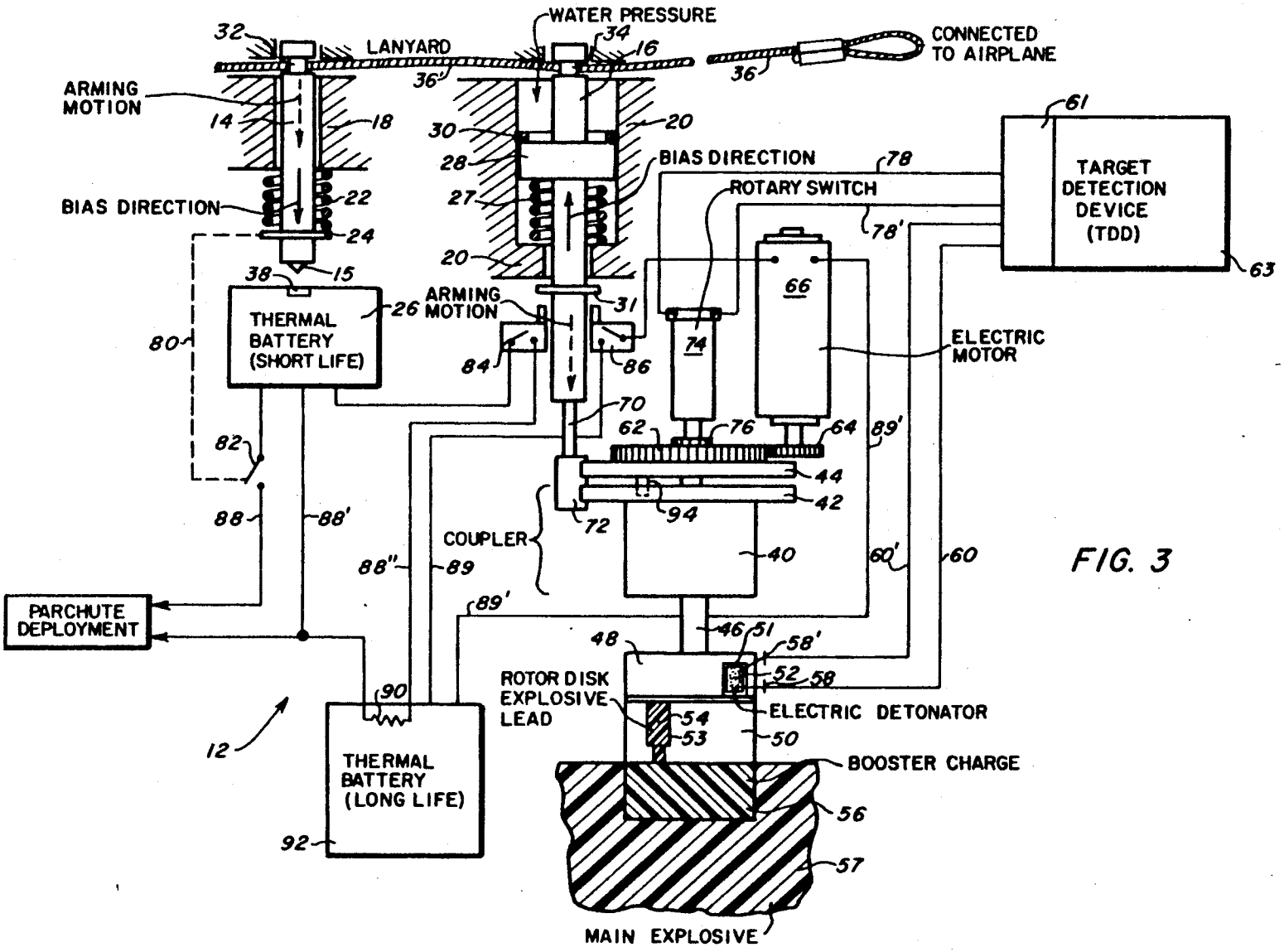
FIG. 3 is a schematic illustration of the deployment and arming device according to the invention.

The parachute deployment and arming device, designated generally by the numeral 12, to which the invention pertains, is mounted within an area of the housing of mine 10 as illustrated in FIG. 2. This device is illustrated schematically in FIG. 3. A pair of normally biased plungers 14 and 16, defining first and second plungers, respectively, are mounted for linear movement within respective housings or housing portions 18 and 20. Biasing means, such as compression spring 22, is disposed about first plunger 14 and anchored between housing 18 and shoulder 24 to normally urge the plunger from its initial position (as shown in FIG. 3) toward thermal battery 26 (i.e., a second position). Biasing means, such as compression spring 27, is disposed about second plunger 16 and anchored between housing 20 and hydrostatic piston 28 to normally urge the plunger outwardly from its initial position shown in FIG. 3. Plungers 14 and 16 are provided with annular rings or recesses 32 and 34, respectively. A lanyard 36 has an end 36' threaded through the rings or recesses and trapped therein by the resilience of plunger 14 to rest against respective housings portions to hold the plungers in their initial or first positions. The other end of the lanyard is provided with a ring or other means for attaching it to the aircraft. As illustrated, the lanyard prevents the plungers from moving from their initial positions. The movement of the plungers and the resulting events will be more fully discussed hereinafter.

A rotatable coupler 40 is located in the general vicinity of the lower end of plunger 16, as illustrated in FIG. 3. The coupler includes a disk head 42. A disk drive 44 is mounted coaxially with coupler 40 in close proximity with disk head 42 which it drives through a pin arrangement 94 which will be described subsequently with reference to FIG. 4. The lower end of coupler 40 is fixedly connected through a shaft 46 for rotating rotor disk, 48 relative to underlying member 50 in facing adjacency, including sliding contact. Rotor disk or rotatable member 48 is adapted for limited rotation with respect to member 50. Rotor disk 48 is provided with a cavity 51 in communication with its lower face, and is adapted for carrying an electric detonator 52. Member 50 is also provided with a cavity 53 in communication between its face and back side. Cavity 53 is filled with an explosive to define a lead 54 directed toward booster charge 56 located adjacent the mine's main explosive charge 57. Electric detonator 52 is adapted to be initiated by an electric signal transmitted to rotor disk 48 through contacts 58 and 58' from leads 60 and 60' of target detection device (TDD) 63. As illustrated in FIG. 3, rotor disk 48 and member 50 are positioned initially with electric detonator 52 and explosive lead 54 approximately 90° out of alignment; therefore, inadvertent initiation the electric detonator would normally fail to ignite explosive lead 54. This provides one of several fail-safe arrangements.

A gear 62 is fixedly mounted coaxially on disk drive 44. A pinion gear 64, mounted on the output shaft of electric motor 66, engages gear 62 for driving it and disk drive 44 once the motor 66 is energized.

Figure 5:
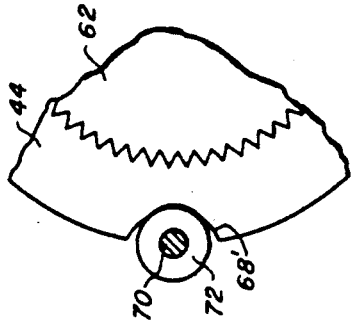
FIG. 5 is a view of FIG. 3 showing the disks restrained from rotation.
Figure 4:
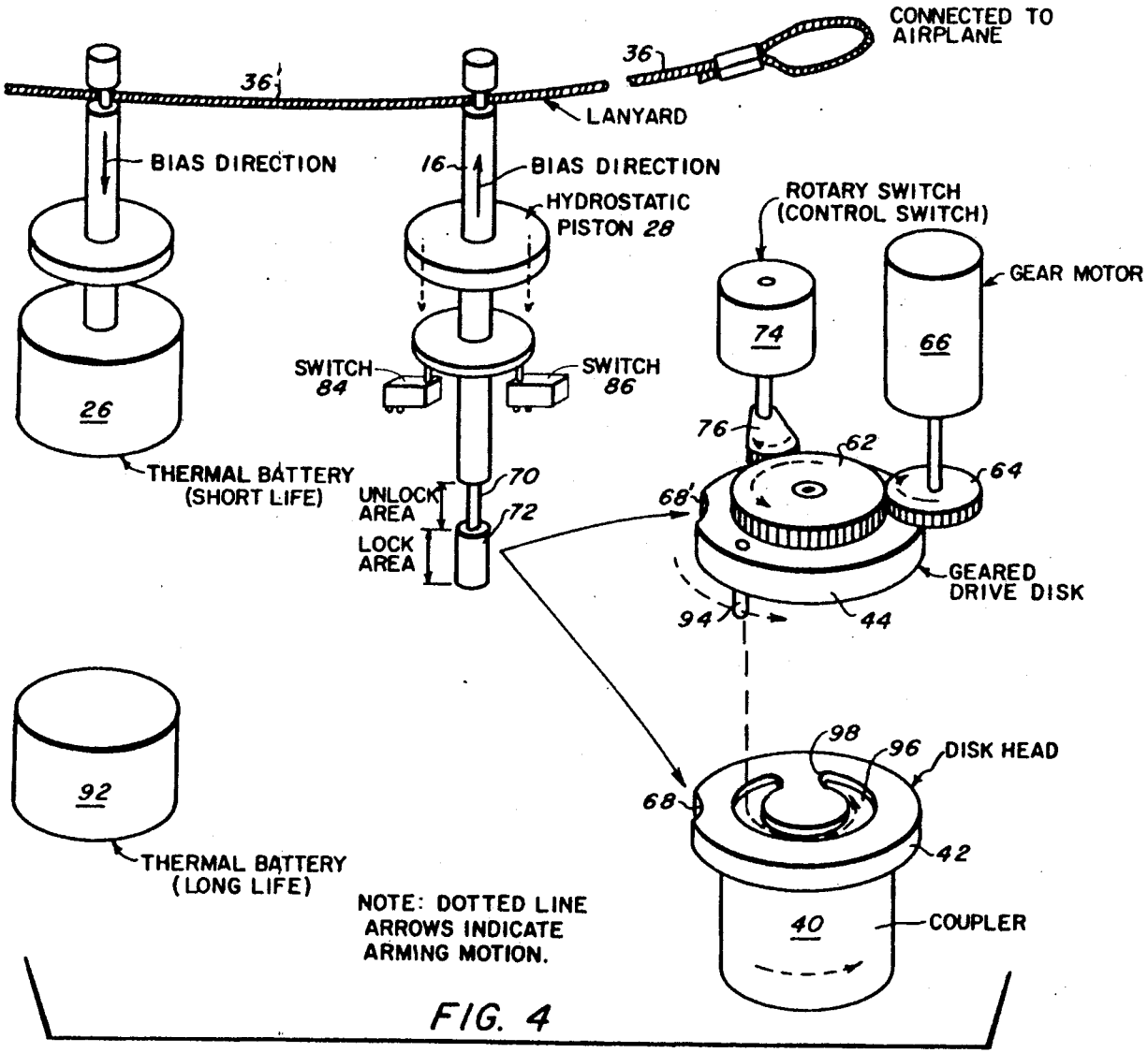
FIG. 4 is an exploded view of only the mechanical features of the arming device illustrated in FIG. 3.

The driving arrangement which couples disk head 42 with disk drive 44 may be more readily understood by referring to the exploded view of mechanical elements in FIG. 4. A pin 94 extends downwardly from the bottom face of disk drive 44 into arcuate slot 96 in the upper face of the disk head. When disk drive 44 rotates, pin 94 first moves within arcuate slot 96 without imparting motion to disk head 42. But when the pin contacts slot end 98, disk head 42 is caused to turn in co-rotation. Arcuate notches 68 and 68' are provided in the periphery of disks 42 and 44, respectively. The lower end of plunger 16 includes a reduced diameter portion 70 which isolates a cylindrical head portion 72 which has a diameter adapted to rest within notches 68 and 68' as illustrated in FIG. 4 and 5. When portion 72 of plunger 16 is in its initial position, as illustrated in FIG. 3, coupler 40 and disc drive 44 are locked together and prevented from rotation, even if electric motor 66 were inadvertently energized. Note FIG. 5 for an additional illustration of the positioning of cylindrical head 72 in the notches.

A rotary switch 74 carries a gear segment 76 in meshed contact with gear 62, as best illustrated in FIG. 4, and is adapted to be actuated upon rotation of gear 62. Rotary switch 74, when actuated, completes a circuit with battery 61 associated with target detection device 63 (FIG. 3) to activate it.

Additional electrical switches are associated with the plungers. Switch 82, illustrated in FIG. 3, is adapted to be closed by mechanical linkage 80 connected with plunger 14. A pair of switches 84 and 86 are adapted to be closed by abutment from an annular ring 31 on plunger 16.

A detailed description of the operation of the device embodying the invention follows. In order to simplify the operation of elements in FIGS. 3 and 4, reference will be made to upper or outward which is toward the top of the drawing.

Once the mine is released from its shackles on the aircraft, it falls away, and lanyard end 36' is pulled free from plungers 14 and 16. Plunger 14 is propelled downward by spring 22 to a second position where (1) its tip 15 strikes procussion primer 38 to activate thermal battery 26 and (2) actuates linkage 80 to close electric switch 82. Thermal battery 26, once activated, almost instantaneously provides electric energy through leads 88, 88' to actuate mechanism (not illustrated) to deploy a parachute from the aft section of the mine to slow its descent into the water.

Plunger 16, now also free of the lanyard end 36', is not allowed to move substantially farther outward by the constant urging of spring 27 because piston 28 hydrostatic is in contact with shoulder portion 30 secured to housing portion 20 as illustrated in FIG. 3. However, once the mine has settled into water beyond a predetermined depth, pressure acting against hydrostatic piston 28 overcomes spring 27 to force plunger 16 downward to a second position where an annular shoulder 31 contacts and closes switches 84 and 86. With the closing of switch 84, a circuit is completed through lines 88' and 88'' to electrical resistance element 90 for activating long life thermal battery 92. When plunger 16 moves downward, it moves cylindrical head portion 72 out of holding engagement in notches 68, 68' to free disk head 42 and disk drive 44 for rotation.

With the concurrent closing of electric switch 86 by downward movement of ring 31 on plunger 16, a circuit is completed through leads 89, 89' connected with battery 92 to drive electric motor 66. As motor 66 rotates, its pinion 64 drives gear 62 to rotate disk drive 44, which, in turn, drives through disk head 42 to rotate coupler 40. With the rotating of disk drive 44, gear segment 76, as best illustrated in FIG. 4, pivots to actuate rotary switch 74. Pin 94 travels along arcuate slot 96 in disk head 42 until it comes to slot end 98, after which it rotates disk head 42, coupler 40 and disk 48 to align electric detonator 52 with explosive lead 54. Means not illustrated cause gear motor 66 to cease rotation once detonator 52 has moved into alignment with explosive lead 54. After gear segment 76 has pivoted through a predetermined arc, it oscillates on the teeth of gear 62 for the period of time it continues to rotate The actuation of rotary switch 74 causes it to send a direct current signal from the battery 61 to target detection device 63 to activate it.

Upon detection of a target which meets previously programmed criteria, target detection device 63 sends a signal through leads 60, 60' to fire electric detonator 52, the discharge of which ignites aligned explosive lead 54 which is in firing communication with booster charge 56 of main explosive 57. For this firing to occur, all the above steps had to take place in the proper sequence.

From the foregoing it will be apparent that the present invention provides a new and improved parachute deployment and mine arming or activating system.

Obviously, many modifications and variations of the present invention are possible in light of the above teachings. It is, therefore, to be understood that the invention is limited only by the scope of the claims annexed hereto.

I claim:

1. A device for aiding deployment of a naval mine from an aircraft and initiating its activation at beyond predetermined water depth, comprising:

a pair of biased plungers restrained in respective initial positions by a releasing lanyard adapted for connected to the aircraft;

a first plunger of the pair adapted upon lanyard release to be moved by its bias to a second position for initiating battery activation and closing a circuit adapted to actuated means to deploy a parachute for slowing air descent of the mine;

a pair of facing members, one being rotatable and carrying a detonator and the other carrying an explosive lead which is in communication with an explosive charge;

a second plunger of the pair when in its initial position locking the rotatable member from rotation with the detonator out of communication with the explosive lead in the other member;

said second plunger upon lanyard release adapted to be moved by water pressure at beyond a predetermined depth against its bias to a second position for unlocking the rotatable member, thereby freeing the rotatable member for rotation and, means responsive to the second plunger when in its second position for causing rotation of the rotatable member for aligning the detonator and explosive lead in communication; and, means for activating a target detecting device after the rotatable member is rotated to align the detonator and explosive lead;

said target detecting device once activated adapted to fire the detonator upon detecting a target.

2. The invention according to claim 1 including means for electrical initiating the detonator.

3. The invention according to claim 1 further defined by the facing one and other members in being in close adjacency.

4. The invention according to claim 3 wherein the faces of the members are in sliding contact.

5. A device for aiding deployment of a naval mine from air into water and activating it at a predetermined water depth, comprising:

biased means restrained against movement by a lanyard which is adapted to be connected to an aircraft;

said biased means adapted for release from the lanyard after the mine is dropped from the aircraft;

a first of the biased means after lanyard release adapted to move to another position for activating a battery and closing a circuit to activate means for deploying a parachute from the mine;

a pair of interfacing members, one of which is rotatable and carries a detonator and the other contains an explosive lead;

a second of the biased means normally locking the one member from rotation with the detonator and explosive lead out of explosive communication;

said second biased means, after lanyard release and after the mine has settled into water beyond a predetermined depth, adapted to be moved by water pressure to anther position for unlocking the one member;

power means caused to be energized by the second biased means when in its said another position for causing means to rotate the one member to place the detonator and explosive lead in explosive communication; and means for energizing an electric circuit for activating a target detecting device after the rotatable member is rotated to align the detonator and explosive lead.

6. The invention according to claim 5 further defined by the relatively rotatable members having faces in sliding engagement.

7. The invention according to claim 5 further including means for electrically activating the detonator.

8. The invention according to claim 5 wherein the explosive lead is in communication with a booster charge of explosive.

* * * * *